United States Patent [19]

Blotenberg

[11] Patent Number: 4,936,741

[45] Date of Patent: Jun. 26, 1990

[54] METHOD OF REGULATION THAT PREVENTS SURGE IN A TURBOCOMPRESSOR BY INITIATING BLOW-OFF WHEN NECESSARY

[75] Inventor: Wilfried Blotenberg, Dinslaken, Fed. Rep. of Germany

[73] Assignee: MAN Gutehoffnungshütte AG, Oberhausen, Fed. Rep. of Germany

[21] Appl. No.: 321,517

[22] Filed: Mar. 9, 1989

[30] Foreign Application Priority Data

Apr. 2, 1988 [DE] Fed. Rep. of Germany ..... 3811232

[51] Int. Cl.[5] ..... F04D 27/02

[52] U.S. Cl. ..... 415/27

[58] Field of Search ..... 415/1, 17, 26, 27, 28, 415/13

[56] References Cited

U.S. PATENT DOCUMENTS

| | | | |
|---|---|---|---|
| 4,139,328 | 2/1979 | Kuper et al. | 415/27 |
| 4,384,818 | 5/1983 | Blotenberg | 415/17 |
| 4,464,720 | 8/1984 | Agarwal | 415/17 |
| 4,781,524 | 11/1988 | Blotenberg | 415/1 |
| 4,789,298 | 12/1988 | Blotenberg | 415/27 |
| 4,796,213 | 1/1989 | Blotenberg | 415/26 |
| 4,831,534 | 5/1989 | Blotenberg | 415/1 |

*Primary Examiner*—Robert E. Garrett
*Assistant Examiner*—John T. Kwon
*Attorney, Agent, or Firm*—Max Fogiel

[57] ABSTRACT

A regulating method for preventing surges in a turbocompressor by initiating blow-off when necessary during operation. Flow to the turbocompressor and the compressor outlet pressure are measured continuously, and a first regulating difference is calculated from these measurements. This first regulating difference is then applied as an input parameter to a regulator which has a limited response rate. The output of this regulator is then used as a regulating parameter for a blow-off valve. The blow-off valve is opened rapidly by safety controls under malfunctioning conditions that tend to stress the limited response rate of the regulator. A second regulating difference is calculated from the preceding measurements or from the first regulating difference to indicate the need to open rapidly the blow-off valve. The calculation of the second regulating difference is carried out with predetermined reference values, and this calculated second regulating difference is applied to a threshold stage which emits a rapid-opening parameter when the second regulating difference exceeds a predetermined threshold stored in that threshold stage. The rapid-opening parameter is forwarded to the regulator, and an accelerated change in a valve-adjustment parameter is generated in the regulator by additive superposition for activating the valve in the opening direction to protect the turbocompressor against occurrence of pressure surges.

9 Claims, 3 Drawing Sheets

METHOD OF REGULATION THAT PREVENTS SURGE IN A TURBOCOMPRESSOR BY INITIATING BLOW-OFF WHEN NECESSARY

The invention concerns a method of regulation that prevents surge in a turbocompressor by initiating blow-off when necessary, whereby the flow to the compressor and the compressor-outlet pressure are continuously measured and employed to calculate a regulating difference that is forwarded in the capacity of an input parameter to a regulator that supplies an output in the form of a parameter for regulating a blow-off valve to the blow-off valve and whereby safety controls initiate rapid opening of the blow-off valve when serious and/or sudden malfunctions that overtax the limited response rate of the regulator occur.

In known and conventional regulating methods of this type, the normal regulating procedure carried out the regulator is intentionally limited to the rate of response or to the rate of change of the adjustment parameter for the blow-off valve in order to maintain a stable and non-fluctuating regulating procedure and prevent the blow-off valve from constantly opening and closing. This type of regulator necessitates the aforesaid safety controls to rapidly open the blow-off valve in an emergency, when the serious and/or sudden malfunctions occur. The measurement results are employed to determine whether the compressor's operating point has crossed a safety curve that parallels the surge limit in the performance field. If the operating point does cross the safety curve, a switchover valve is activated and initiates rapid and complete opening of the blow-off valve subject to a resilient force.

The drawback to this method of regulation is that the pressure in the process downstream of the compressor drops extensively whenever the safety controls are activated. The method also demands complicated engineering, especially because of the requisite additional switchover valve and means of storing the resilient force that rapidly opens the blow-off valve.

The object of the invention is accordingly to provide a method of the aforesaid type that will not have the aforesaid drawbacks, that will in particular ensure an approximately constant pressure in the process downstream of the compressor even when serious and/or sudden malfunctions occur, and that will not demand complicated engineering.

This object is attained in a method of the aforesaid type in accordance with the invention in that an additional regulating difference (x') that indicates that it is necessary to rapidly open the blow-off valve is calculated from the results of measurement or from the first regulating difference (x) in conjunction with prescribed reference values and supplied to a threshold stage that outputs a rapid-opening parameter (z) when the second regulating difference exceeds a prescribed threshold stored in the threshold stage, whereby the rapid-opening parameter is forwarded to the regulator (4), wherein it generates by means of additive superposition an accelerated change in the valve-adjustment parameter (y) that activates the valve along its opening direction.

The advantage of the new method is that it can be employed in conjunction with and as a supplement to the known method of regulation, increasing the latter's disadvantageously limited rate of response in adjusting the blow-off valve to such an extent that the blow-off valve can be reliably opened in plenty of time when necessary, even when serious and/or sudden malfunctions occur. Since, moreover, the rapid-opening parameter continues to exist only as long as the second regulating difference is exceeding its assigned threshold, the rapid-opening parameter will no longer be output once the second regulating difference has dropped back below the threshold, and the blow-off valve will from that point on continue to be regulated by the more slowly responding normal regulating procedure. The blow-off valve is accordingly rapidly opened only wide enough and long enough to prevent the compressor from surging. Another advantage of the new method is that no special accessory mechanisms are needed. It exploits the means of adjusting the blow-off valve already present.

One preferred embodiment of the invention provides that the actual speed of the compressor's operating point in the performance field is calculated from the regulating difference (x) that represents the position of the point in the field and in that the difference between the actual speed and a reference speed that is associated with it spatially in accordance with a prescribed position-speed function that will just prevent surging when the operating point arrives at it is calculated and employed as the second regulating difference (x'). The significance of this procedure is that the speed at which the operating point is approaching the surge limit in the performance field is employed along with the distance of the operating point from the surge limit to decide whether to rapidly open the blow-off valve. The prescribed position-speed function is represented by a curve that is plotted such that the compressor will not start to surge when the operating point travels slightly beyond the curve. Although the rapid opening of the blow-off valve will of course be immediately initiated once this curve has been arrived at, the operating point will have crossed the curve to a certain extent by the time the blow-off valve can respond and before its opening can affect the position of the operating point. This situation must be taken into account when plotting the curve by ensuring that it extends at a sufficient margin of safety, which may be relatively small, however, away from the surge limit.

The compressor will accordingly be able to continue operating safely closer to the surge limit without essentially making the method more complicated with the exception of a certain number of simple computations.

The method also provides that the rapid-opening parameter is output in the form of a ramped, stepped, discontinuous, or pulse-sequence function that increases and decreases in accordance with time. The type of function to be employed depends on the individual situation, especially on how the blow-off valve and its associated activating mechanism operate. It is practical to adapt the slope of the function to the maximum speed of the blow-off valve, which is dictated by engineering criteria and is always higher than the maximum rate at which the regulator changes in relation to the valve-adjustment parameter.

DESCRIPTION OF THE PREFERRED EMBODIMENTS

Figure 1:
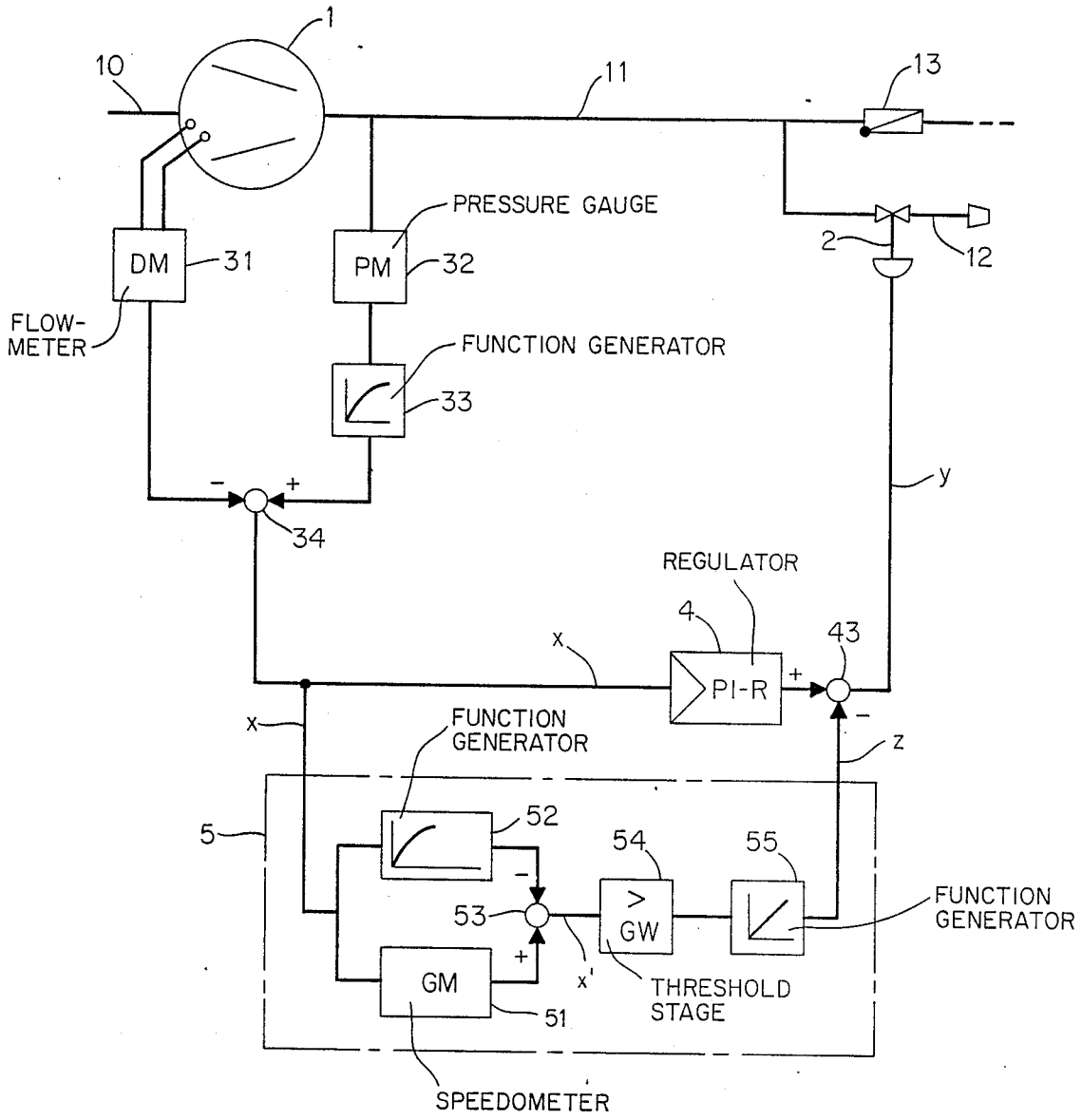
FIG. 1 is a schematic view of the essential element of first embodiment of the present invention.

FIG. 1 illustrates a turbocompressor 1 with an intake line 10 and an outlet line 11 that accommodates a check valve 13. Branching off of outlet line 11 upstream of check valve 13 is a blow-off line 12 that accommodates a blow-off valve 2. The flow of the incoming medium that is to be compressed, air for example, is continuously measured at the intake end of compressor 1 by a flowmeter 31. Downstream of compressor 1, a pressure gauge 32 that communicates with outlet line 11 continuously measures the pressure at the outlet of the compressor. A function generator 33 determines the minimum-flow value just permissible in relation to the measured pressure. The minimum-flow value emitted by function generator 33 is employed as a reference value and the flow value measured by flowmeter 31 as an actual value. The actual value is forwarded with a negative mathematical sign to an adder 34 that constructs a regulating difference x, which is by definition the difference between the reference value and the actual value. Regulating difference x is forwarded to the input terminal of a proportional-integral regulator 4 that outputs an adjustment parameter y, which is forwarded to and regulates the state of blow-off valve 2. To the extent described up to this point, the method of regulation corresponds to the known state of the art.

What is novel about the embodiment illustrated in FIG. 1 is that first regulating difference x is also supplied to safety controls 5 wherein the rate of change of regulating difference x, the speed, that is, at which the operating point of compressor 1 is traveling in the performance field, is calculated in a speedometer 51. Regulating difference x is simultaneously forwarded to another function generator 52 that stores a prescribed position-speed function. As the operating point arrives at the curve representing this function, it will still be just possible to prevent compressor 1 from surging. In other words, until the operating point arrives at the curve, it will be unnecessary for the safety controls to intervene to protect compressor 1. The curve itself represents the very latest time at which the valve will have to begin opening to still be able to prevent arrival at the surge limit. The shape of the curve and its distance from the surge limit are dictated by such properties of the blow-off valve as its behavior when adjusted, its non-linearity, etc. At the outlet end, function generator 52 always outputs the reference speed associated with the regulating difference x output by the adder. Another adder 53 constructs the difference between the actual speed output by speedometer 51 and the reference speed output by function generator 52 and provides it with a negative mathematical sign. This difference is forwarded in the capacity of a second regulating difference x' to a threshold stage 54. Threshold stage 54 compares second regulating difference x' with a prescribed threshold that is stored in threshold stage 54 and corresponds to the aforementioned margin of safety. If second regulating difference x' exceeds this threshold, threshold stage 54 will output what is called a rapid-opening parameter z. In the embodiment illustrated in FIG. 1, rapid-opening parameter z is generated by a function generator 55 that outputs a ramped function that constantly increases in accordance with time. If blow-off valve 2 has a non-linear rate of adjustment, function generator 55 can be designed to precisely vary the slope of the output function in accordance with time to ensure that blow-off valve 2 will always be adjusted at its maximum rate. The state of blow-off valve can also be feedbacked to function generator 55 to ensure that the rate of adjustment constantly matches the actual valve state.

Rapid-opening parameter z is provided with a negative mathematical sign and forwarded to the output terminal of proportional-integral regulator 4, where it is added in an adder 43 to the adjustment parameter y generated by proportional-integral regulator 4 to create a modified adjustment parameter y. Since the blow-off valve 2 in the present example (as well as in the examples hereinafter described) opens by definition as adjustment parameter y decreases, adding rapid-opening parameter z to adjustment parameter y will suddenly make blow-off valve 2 start to open. The slope of the ramp function emitted by function generator 55 matches the maximum possible rate at which blow-off valve 2 can be adjusted. The resulting rate of change in adjustment parameter y is higher than what could be attained by proportional-integral regulator 4 alone. As an alternative, the output from threshold stage 54 can be forwarded directly to adder 43, eliminating the need for function generator 55. The level of the signal output by threshold stage 54 must be high enough to change adjustment parameter y when added to it in adder 43 to the extent that blow-off valve 2 will receive a command to open completely. Blow-off valve 2 will be following adjustment parameter y as rapidly as possible. Although this version of the method is accordingly especially simple, it can result in an occasional difference between adjustment parameter y and the actual valve setting.

Figure 2:
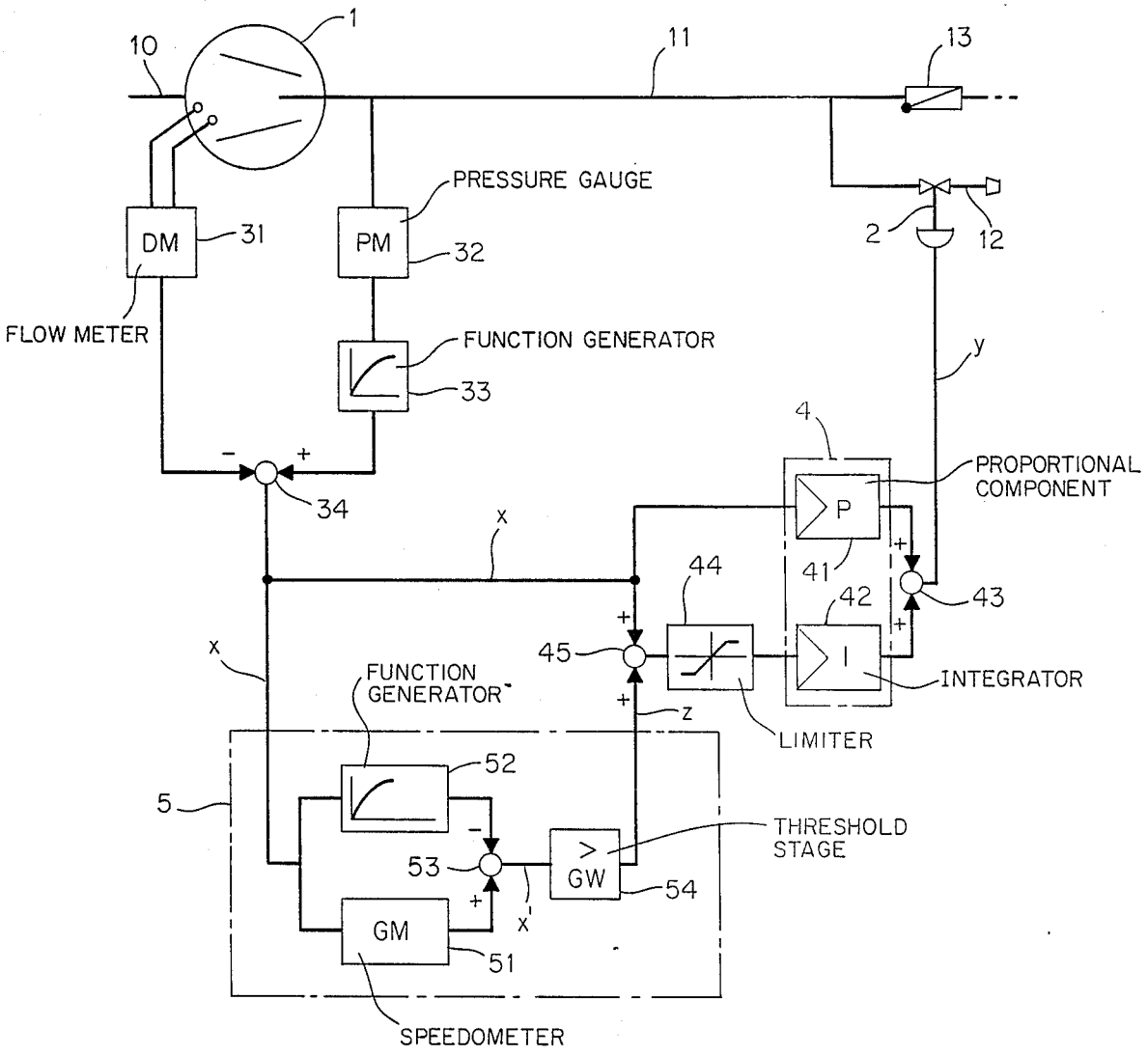
FIG. 2 is a schematic view of the essential element of second embodiment of the present invention.

FIG. 2 also illustrates a turbocompressor 1 with an intake line 10 and an outlet line 11 that accommodates a check valve 13. Here again a blow-off line 12 branches off from outlet line 11 and accommodates a blow-off valve 2. An initial regulating difference x is again determined in the same way described with reference to FIG. 1 by means of measured and reference values obtained with a flowmeter 31, a pressure gauge 32, and a function generator 33 with a downstream adder 34. Furthermore, the regulator is again a proportional-integral regulator 4.

What is novel to this embodiment is that not only regulating difference x but also the rapid-opening parameter z calculated by safety controls 5 is supplied to the intake end of proportional-integral regulator 4. In this case, first regulating difference x alone is supplied at the intake end to the proportional component 41 of proportional-integral regulator 4, whereas the sum of first regulating difference x and rapid-opening parameter z is supplied at the intake end to the integral component 42 of the regulator. The sum of first regulating difference x and rapid-opening parameter z is constructed in an adder 45 upstream of the integral component 42 of proportional-integral regulator 4. Between adder 45 and the input terminal of integral component 42 is a limiter 44 that ensures that the time constant of the integral component will not become shorter than the time it takes to adjust the blow-off valve.

Second regulating difference x' is calculated in the version illustrated in FIG. 2 in the same way as in the version illustrated in FIG. 1, and is again supplied to a threshold stage 54 that, when second regulating difference x' exceeds a threshold stored therein, outputs rapid-opening parameter z to adder 45.

An adder 43 is positioned downstream of proportional component 41 and integral component 42 at the outlet end of proportional-integral regulator 4. Adder 43 adds the outputs from proportional component 41 and integral component 42 to construct a parameter y for adjusting blow-off valve 2.

Figure 3:
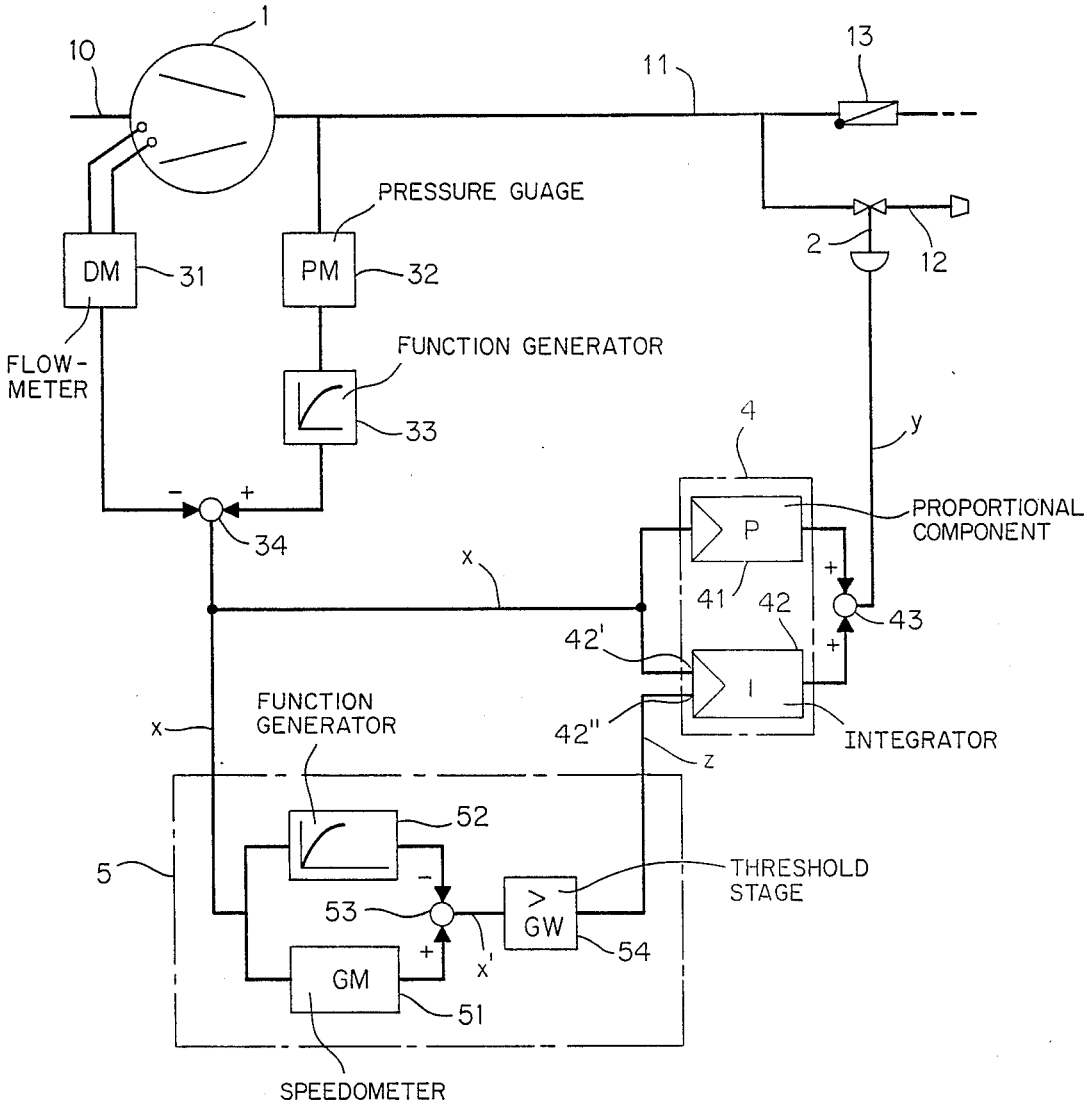
FIG. 3 is a schematic view of the essential element of third embodiment of the present invention.

FIG. 3 illustrates a third advantageous embodiment of the method, which again involves a compressor 1 with an intake line 10, an outlet line 11, a blow-off line 12, a check valve 13, and a blow-off valve 2. First regulating difference x is again determined as described with reference to FIGS. 1 and 2, and safety controls 5 determine rapid-opening parameter z precisely as described with reference to FIG. 2.

The regulator is again a proportional-integral regulator 4 with a proportional component 41 and an integral component 42. First regulating difference x is again supplied to proportional component 41 and both first regulating difference x and rapid-opening parameter z are supplied at the intake end to integral component 42. In contrast to the embodiment described with reference to FIG. 2, however, the integral component 42 of proportional-integral regulator 4 has two integrator input terminals 42' and 42''. First regulating difference x is assigned to input terminal 42' and rapid-opening parameter z to input terminal 42''. The advantage of this version is that input terminals 42' and 42'' can carry out different integration processes, can, that is, be assigned different integration time constants. The output of integral component 42 can accordingly be effectively modified in accordance with rapid-opening parameter z without being affected by first regulating difference x.

The outputs from the proportional component 41 and the integral component 42 of proportional-integral regulator 4 are in this case as well added in an adder 43 to construct the parameter y for adjusting blow-off valve 2.

One of the advantages of the two versions described with reference to FIGS. 2 and 3 is that rapid-opening parameter z acts by way of the integral component 42 of the regulator, ensuring that the output from the regulator will follow the change in the adjustment parameter while blow-off valve 2 is rapidly opening.

What is common to all the embodiments described herein is that the turbocompressor is normally regulated by the normal regulator, proportional-integral regulator 4 in the present case. Only when malfunctions occur will safety controls 5 come into action and additively modify the parameter y for adjusting blow-off valve 2 to make it open more rapidly.

I claim:

1. A regulating method for preventing surges in a turbocompressor by initiating blow-of when necessary, comprising the steps: measuring continuously flow to a turbocompressor and the compressor outlet pressure; calculating a first regulating difference from said measuring step; forwarding said first regulating difference as an input parameter to a regulator having a limited response rate; supplying an output of said regulator as a regulating parameter to a blow-off valve; opening rapidly said blow-off valve by safety controls under malfunctioning conditions that stress the limited response rate of said regulator; calculating a second regulating difference from said measuring step or from said first regulating difference for indicating need to open rapidly said blow-off valve, calculating said second regulating difference being carried out with predetermined reference values; supplying the calculated second regulating difference to a threshold stage emitting a rapid-opening parameter when said second regulating difference exceeds a predetermined threshold stored in said threshold stage; forwarding said rapid-opening parameter to said regulator; and generating by additive superposition in said regulator an accelerated change in a valve-adjustment parameter for activating said valve in opening direction to protect the turbocompressor against occurrence of pressure surges, said regulator being a proportional-integral component; supplying only said first regulating difference to said proportional component; and supplying the sum of said first regulating difference and said rapid-opening parameter to said integral component.

2. A method as defined in claim 1, including the step of passing said sum of said first regulating difference and said rapid-opening parameter through a limiter before entering said integral component of said proportional-integral regulator.

3. A regulating method for preventing surges in a turbocompressor by initiating blow-off when necessary, comprising the steps: measuring continuously flow to a turbocompressor and the compressor outlet pressure; calculating a first regulating difference from said measuring step; forwarding said first regulating difference as an input parameter to a regulator having a limited response rate; supplying an output of said regulator as a regulating parameter to a blow-off valve; opening rapidly said blow-off valve by safety controls under malfunctioning conditions that stress the limited response rate of said regulator; calculating a second regulating difference from said measuring step or from said first regulating difference for indicating need to open rapidly said blow-off valve, calculating said second regulating difference being carried out with predetermined reference values; supplying the calculated second regulating difference to a threshold stage emitting a rapid-opening parameter when said second regulating difference exceeds a predetermined threshold stored in said threshold stage; forwarding said rapid-opening parameter to said regulator; and generating by additive superposition in said regulator an accelerated change in a valve-adjustment parameter for activating said valve in opening direction to protect the turbocompressor against occurrence of pressure surges, said regulator being a proportional-integral regulator having an integrator as an integral component with two input terminals, integrating through one of said input terminals by a procedure that is independent of the other input terminal, supplying said first regulating difference to said other input terminal, and supplying said rapid-opening parameter to said first input terminal.

4. A method as defined in claim 3, including the step of assigning different integration time constants to said two input terminals of said integral component.

5. A regulating method for preventing surges in a turbocompressor by initiating blow-off when necessary, comprising the steps: measuring continuously flow to a turbocompressor and the compressor outlet pressure; calculating a first regulating difference from said measuring step; forwarding said first regulating difference as an input parameter to a regulator having a limited response rate; supplying an output of said regulator as a regulating parameter to a blow-off valve; opening rapidly said blow-off valve by safety controls under malfunctioning conditions that stress the limited response rate of said regulator; calculating a second regulating difference from said measuring step or from said first regulating difference for indicating need to open rapidly said blow-off valve, calculating said second regulating difference being carried out with predetermined reference values; supplying the calculated second regulating difference to a threshold stage emitting a rapid-opening parameter when said second regulating difference exceeds a predetermined threshold stored in said threshold stage; forwarding said rapid-opening parameter to said regulator; and generating by additive superposition in said regulator an accelerated change in a valve-adjustment parameter for activating said valve in opening direction to protect the turbocompressor against occurrence of pressure surges.

6. A method as defined in claim 5, wherein said compressor has an operating point with actual speed in its performance field; calculating said actual speed from said first regulating difference representing the position of said operating point in said field; calculating said second regulating difference from the difference between said actual speed and a reference speed associated spatially with said actual speed in accordance with a predetermined position-speed function that will just prevent surging when said operating point arrives at said function.

7. A method as defined in claim 5, wherein said rapid-opening parameter is a function that increases and decreases in accordance with time.

8. A method as defined in claim 5, including the step of forwarding said rapid-opening parameter to an output terminal of said regulator; and adding said rapid-opening parameter with its mathematical sign modified to said valve-adjustment parameter output by said regulator.

9. A method as defined in claim 5, including the step of adjusting an output of said regulator to a level corresponding to the actual state of said blow-off valve while said rapid-opening parameter is being emitted by said threshold stage.

* * * * *